United States Patent [19]

Kautt

[11] Patent Number: 4,875,727

[45] Date of Patent: Oct. 24, 1989

[54] COVERING ELEMENT FOR MULTILOCK FITTING FASTENED TO A DOOR, WINDOW OR THE LIKE

[75] Inventor: Jean-Jacques Kautt, Strasbourg, France

[73] Assignee: Ferco International, Sarrebourg, France

[21] Appl. No.: 132,363

[22] Filed: Dec. 14, 1987

[30] Foreign Application Priority Data

Dec. 24, 1986 [FR] France ..... 86 18472

[51] Int. Cl.[4] ..... E05C 21/00

[52] U.S. Cl. ..... 292/337

[58] Field of Search ..... 292/36, 92, 337, DIG. 53, 292/DIG. 71

[56] References Cited

U.S. PATENT DOCUMENTS

| | | | |
|---|---|---|---|
| 2,207,877 | 7/1940 | Schlage | 292/337 X |
| 3,001,664 | 9/1961 | Flint | 292/337 X |
| 3,038,436 | 6/1962 | Stebbins | 292/92 X |
| 3,151,350 | 10/1964 | Manion | 292/357 X |
| 3,563,585 | 2/1971 | Welch | 292/92 |
| 3,910,612 | 10/1975 | Guiraud | 292/337 X |

*Primary Examiner*—Richard E. Moore

*Attorney, Agent, or Firm*—Sandler & Greenblum

[57] ABSTRACT

A cover member is adapted to a multilock fitting applicable to doors, windows or the like, this fitting consisting essentially of a casement bolt, or a plurality of lock- or striker plate blocks. The cover member consists of a rectangular-sectioned tubular element of which one of the minor sides is coplanar with the lateral edge of the jamb of the movable or fixed frame of the door, window or the like, one of the major sides of the tubular element provided with apertures covering the plurality of lock- or striker plate blocks and comprising detent-positioning means interposed between the lock- or striker plate blocks and the inner surface of the movable or fixed frame, respectively, of the door, window or the like.

11 Claims, 1 Drawing Sheet

COVERING ELEMENT FOR MULTILOCK FITTING FASTENED TO A DOOR, WINDOW OR THE LIKE

BACKGROUND OF THE INVENTION

1. FIELD OF THE INVENTION

The present invention relates to multilock or multipoint fittings for doors, windows or the like, and has specific reference to an improved multilock fitting cover applicable to a door, window or the like, and consisting of a casement bolt, or a plurality of lock blocks, or of keepers or striker plate blocks.

2. THE PRIOR ART

A lock system in which a plurality of bolts are actuated simultaneously from a common safety mechanism via driving rods is already known in the art. In mechanism of this type the driving rods connect the safety mechanism to the various bolts adapted to engage the plurality of striker plate or keepers fitted on the jamb of the door, window or the like. The assemlby comprising the bolts, the safety mechanism and the driving rods is housed in a unitary elongated casing fitted to the inner surface of the jamb of the door, window or the like. These casings consist of a pair of interfitting U-section members, one member acting as a cover of the other member. These casings, provided respectively with the safety mechanism, the bolts and the driving rods or the striker plates, are applied in a single fitting operation against the inner surface of the jamb of the movable or the fixed frame, respectively, of the door, window or the like.

However, for obvious safety reasons, it appeared that it would be wise to substitute a plurality of lock blocks, of which the locking members cooperate with a plurality of striker plates, for the single safety mechanism locking system. In fact, a burglar confronted with a plurality of separate lock blocks to be actuated separately and successively will lose more time.

SUMMARY OF THE INVENTION

It is the essential object of the present invention to solve the problem consisting in preserving the advantageous features of an applied cover while permitting the use of a plurality of lock blocks or striker plates in a common structure.

For this purpose, the present invention provides a cover member for a multilock fitting for the frame of a door, window or the like, this fitting comprising a casement bolt or a plurality of lock blocks or a plurality of striker plate blocks, said cover member comprising a rectangular-sectioned sectioned-tubular element of which one of the minor sides is coplanar with the edge of the jamb of the movable or fixed frame of the door, window or the like, one of the major sides of the rectangular-sectioned tubular element covering said plurality of lock- or striker plate blocks.

According to another feature characterizing the invention, the major side of the rectangular-sectioned tubular element comprises detentpositioning means interposed between the lock- or striker plate blocks and the inner surface respectively of the movable or fixed frame of the door, window or the like.

According to a further feature of the invention, the minor side of the rectangular-sectioned tubular element coplanar with the edge of the jamb of the movable or fixed frame of the door, window or the like comprises apertures permitting the passage of the locking members or bolts.

THE DRAWINGS

DESCRIPTION OF THE PREFERRED EMBODIMENTS

Figure 1:
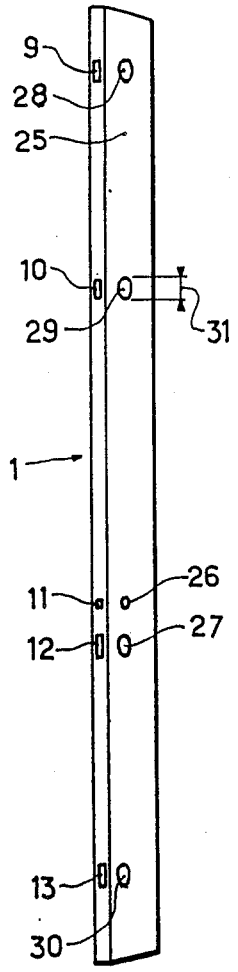
FIG. 1 is a perspective view of the cover member according to the present invention.
Figure 2:
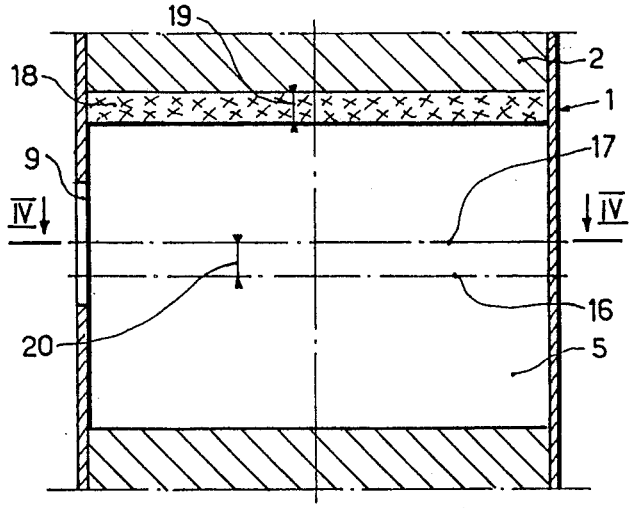
FIG. 2 is a fragmentary sectional and elevational view of the cover member, showing the detent-positioning means according to a first form of embodiment.

According to the present invention, the multilock fitting cover for doors, windows or the like, applicable to the inner surface of a door, window or the like, comprises a tubular section member 1. Due to the overall dimensions of the lock blocks or striker plate blocks, this tubular section member 1 has a rectangular cross-sectional contour. One of the relatively long or major sides 2 is applied to the inner surface 3 of either the movable frame 4 in the case of covers for lock blocks, or the fixed frame (not shown) in the case of covers for striker plate blocks. This major side 2 comprises apertures 5, 6 permitting the passage of the various lock and/or striker plate blocks which are fitted in position by the various fastening means currently used for this purpose.

One of the relatively long or minor sides 7 of the rectangular-sectioned tubular member 1 is coplanar with the edge 8 of the jamb of either the movable frame 4, or of the fixed frame. In this minor side 7 apertures 9, 10, 11, 12 and 13 are formed which register with the corresponding locking members such as half-turn bolts, fixed-door bolts or slide-bolts, so as to permit the passage of these bolts.

When the tubular rectangular-sectioned member 1 is used as a cover for lock blocks, the locking members or bolts project from the outer surface 14 of the minor side 7, and when the tubular rectangular-sectioned member 1 is used as a cover for striker plate blocks, the locking members or bolts project from the inner face 15 of the minor side 7.

Since the major side 2 of the tubular rectangular-sectioned member 1 comprises apertures 5, 6 in alignment with the lock blocks and/or striker plate blocks, it can cover these various blocks engaged therein through said apertures 5, 6. However, the median axis 16 of said apertures 5, 6 is shifted with respect to the axis 17 of apertures 9, 10, 11, 12 and 13. Preferably, this median axis 16 is disposed above the axis 17.

According to the present invention, the tubular rectangular-sectioned member 1 comprises detent-positioning means interposed between the lock or striker plate blocks and the inner face 3 of the movable frame 4 or of the fixed frame.

Figure 3:
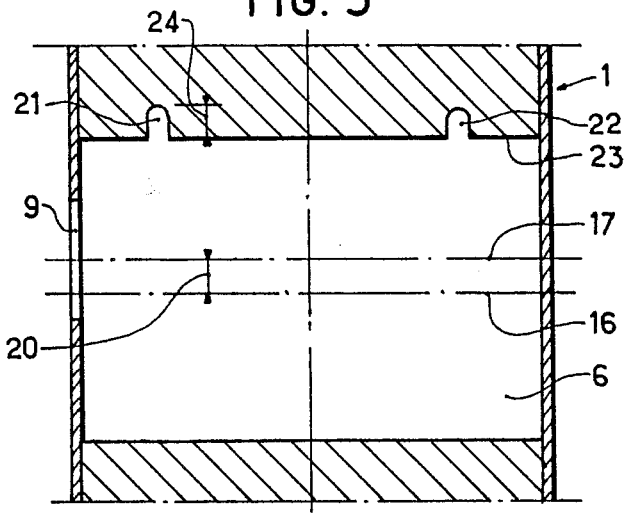
FIG. 3 is a fragmentary sectional and elevational view of the cover member, showing the detent-positioning means according to another form of embodiment of the invention.
Figure 4:
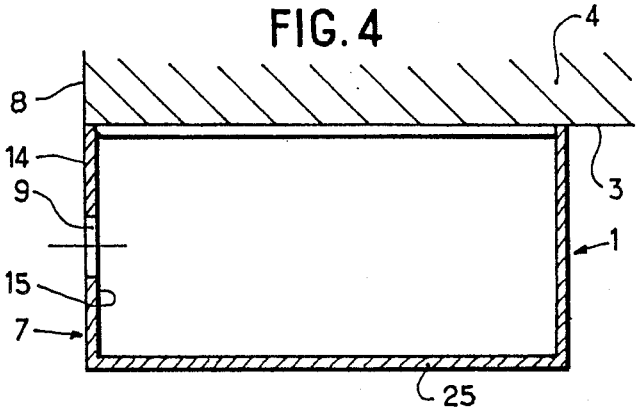
FIG. 4 is a section taken along the line IV—IV of FIG. 2.

In a first form of embodiment, the detent-positioning means consist either of an active area(s) 18 overlying the apertures 5 and/or 6, which is (shown only over aperture 6 in FIG. 3) adapted to cling to the rear face of the various blocks and slide vertically downwards in order to position the cover between the outer face of the various blocks and the inner surface 3 of the movable or fixed frame 4. The height 19 of this active area 18 is at least equal to the distance 20 between the axis 17 and the median plane 16, this distance 20 corresponding to the vertical stroke of the tubular section member with respect to the various lock- or striker plate blocks.

According to a modified form of embodiment, the detent-positioning means consist of notches 21 22 formed across the passage of the fastening members provided for fastening the lock- or striker plate blocks on the inner surface 3 of the movable or fixed frame 4. These notches 21, 22 open on the upper edge 23 of apertures 5 and/or 6 (shown only over aperture 6 in FIG. 3) of tubular member 1. The height 24 of said notches 21, 22 is at least equal to the distance 20 between the axis 17 and the mediam plane 16.

However, said detent-positioning means should not be construed as being limited by the two forms of embodiment described hereinabove.

To actuate the lock blocks, detachable means such as keys and/or handles or knobs are used. Therefore, it is only necessary to provide in the other major side 25 of tubular member 1 other apertures 26, 27 for the passage of the key or handle-bar.

In certain cases, the control means are fixed permanently on the lock. Under these conditions, the other major side 25 of tubular section member 1 must be provided with elongated apertures 28, 29, 30 having a height 31 at least equal to the sum of the diameter of the control means and of the vertical stroke of tubular member 1 which corresponds to the above-defined distance 20.

The assembling step consists simply in applying the tubular section member 1 on the inner surface 3 of the movable or fixed frame 4, care being taken that the lock- or striker plate blocks clear the apertures 5, 6, whereafter the tubular section 1 is pulled downwards so that the detent positioning means 18, 21, 22 will cling to the rear side of the various blocks.

What is claimed is:

1. A cover member for a multilock fitting adapted to be used with a structure including a fixed frame, a movable frame and a jamb with an edge, said multilock fitting comprising a plurality of blocks and a plurality of locking bolts, said cover member comprising a tubular member of rectangular section having a relatively short side and a relatively long side, said relatively short side including a plurality of first apertures permitting passage of said plurality of locking bolts through said relatively short side and positionable so as to be coplanar with said edge of said jamb and said relatively long side covering said plurality of blocks and wherein said relatively long side comprises a plurality of second apertures having median planes, which plurality of second apertures permit passage of said plurality of blocks through said relatively long side, wherein said tubular member is vertically movable relative to said blocks and wherein said plurality of first apertures have axes spaced a predetermined distance from said median planes of said plurality of second apertures, said predetermined distance being equal to the extent of vertical movablility of said tubular member relative to said plurality of blocks.

2. The cover member as recited in claim 1, wherein said movable frame has an inner surface, and wherein said relatively long side comprises detent positioning means interposed between said blocks and said inner surface of said movable frame.

3. The cover member as recited in claim 1, wherein said plurality of second apertures have their median planes disposed beneath the axes of said plurality of first apertures.

4. The cover element as recited in claim 2, wherein said detent positioning means comprises an area of said relatively long side overlying the top edge of said plurality of second apertures, said area being adapted to cling between said plurality of blocks and said inner surface of the movable frame.

5. The cover member as recited in claim 1, further comprising a lock control means having a diameter, and wherein said tubular member of rectangular section further comprises a second relatively long side having a plurality of third apertures permitting the passage of said lock control means through said second relatively long side.

6. The cover member of claim 5, wherein said plurality of third apertures are vertically elongated, and wherein said third apertures have heights that are at least equal to the sum of the diameter of said lock control means and said predetermined distance.

7. A cover member for a multilock fitting adapted to be used with a structure including a fixed frame, a movable frame having an inner surface, and a jamb with an edge, said multilock fitting comprising a plurality of blocks, said cover member comprising a tubular member of rectangular section having a relatively short side and a relatively long side, said relatively short side being positionable so as to be coplanar with said edge of said jamb, said relatively long side covering said plurality of blocks and including detent positioning means interposed between said blocks and said inner surface of said movable frame, and wherein said relatively long side comprises a plurality of second apertures permitting passage of said plurality of blocks through said relatively long side, wherein said plurality of second apertures have top edges, wherein said multilock fitting further comprises means for fastening said plurality of blocks, wherein said tubular member further comprises passage means for said means for fastening said plurality of blocks, and wherein said detent positioning means comprises notches disposed on said relatively long side across said passage means for the means for fastening said plurality of blocks, said notches opening on said top edges of said plurality of second apertures.

8. A cover member for a multilock fitting adapted to be used with a structure including a fixed frame, a movable frame having an inner surface, and a jamb with an edge, said multilock fitting comprising a plurality of blocks, said cover member comprising a tubular member of rectangular section having a relatively short side and a relatively long side, said relatively short side being positionable so as to be coplanar with said edge of said jamb, said relatively long side covering said plurality of blocks and including detent positioning means interposed between said blocks and said inner surface and said movable frame, and wherein said relatively short side comprises a plurality of first apertures having axes, wherein said relatively long side comprises a plurality of second apertures having median planes, wherein said detent positioning means has a height, and wherein the height of said detent positioning means is equal to the distance from the median plane of the plurality of second apertures to the axes of the plurality of first apertures.

9. A cover member for a multilock fitting adapted to be used with a structure including a fixed frame having an inner surface, a movable frame and a jamb with an edge, said multilock fitting comprising a plurality of blocks, said cover member comprising a tubular member of rectangular section having a relatively short side and a relatively long side having detent positioning means interposed between said plurality of blocks and said inner surface, said relatively short side including a plurality of first apertures positionable so as to be coplanar with said edge of said jamb and said relatively long side covering said plurality of blocks, wherein said relatively long side comprises a plurality of second apertures having median planes, wherein said plurality of second apertures have top edges, wherein said multilock fitting further comprises means for fastening said plurality of blocks, wherein said tubular member further comprises passge means for said means for permitting fastening of said plurality of blocks, and wherein said detent positioning means comprises notches in said relatively long side disposed across said passage means for the means for fastening said plurality of blocks, said notches opening on said top edges of said plurality of second apertures.

10. The cover element as recited in claim 9, wherein said fixed frame includes an inner surface, said detent positioning means comprises an area of said relatively long side overlying the top edge of said plurality of second apertures, said active area being adapted to cling between said plurality of blocks and the inner surface of said fixed frame.

11. The cover member as recited in claim 9, wherein said detent positioning means have heights, and wherein the height of said detent positioning means is equal to the distance from said median planes of said second apertures to said axes of said first apertures.

* * * * *